US010482855B2

(12) United States Patent
Motohashi et al.

(10) Patent No.: US 10,482,855 B2
(45) Date of Patent: Nov. 19, 2019

(54) HI-HAT CYMBAL SOUND GENERATION APPARATUS, HI-HAT CYMBAL SOUND GENERATION METHOD, AND RECORDING MEDIUM

(71) Applicant: KORG INC., Tokyo (JP)

(72) Inventors: Haruhiko Motohashi, Tokyo (JP); Masahiko Akino, Tokyo (JP); Tatsuya Nishikawa, Tokyo (JP)

(73) Assignee: KORG INC., Tokyo (JP)

( * ) Notice: Subject to any disclaimer, the term of this patent is extended or adjusted under 35 U.S.C. 154(b) by 0 days.

(21) Appl. No.: 16/196,353

(22) Filed: Nov. 20, 2018

(65) Prior Publication Data

US 2019/0156798 A1 May 23, 2019

(30) Foreign Application Priority Data

Nov. 22, 2017 (JP) ..... 2017-224358

(51) Int. Cl.

| | |
|---|---|
| ***G10D 13/06*** | (2006.01) |
| ***G10H 1/00*** | (2006.01) |
| ***G10H 1/46*** | (2006.01) |
| ***G10H 1/06*** | (2006.01) |

(52) U.S. Cl.

CPC ..... *G10D 13/065* (2013.01); *G10H 1/0041* (2013.01); *G10H 1/06* (2013.01); *G10H 1/46* (2013.01)

(58) Field of Classification Search

CPC ..... G10D 13/065; G10H 1/0041; G10H 1/06; G10H 1/46

USPC ..... 84/422.3

See application file for complete search history.

(56) References Cited

U.S. PATENT DOCUMENTS

| | | | | |
|---|---|---|---|---|
| 4,528,888 | A * | 7/1985 | Hoshino | G10D 13/065 84/402 |
| 4,932,303 | A * | 6/1990 | Kimpara | G10H 3/146 84/621 |
| 7,408,109 | B1 * | 8/2008 | Freitas | G10H 3/12 84/687 |

(Continued)

FOREIGN PATENT DOCUMENTS

| | | |
|---|---|---|
| JP | 2005195981 A | 7/2005 |
| JP | 2009080444 A | 4/2009 |

*Primary Examiner* — David S Warren
*Assistant Examiner* — Christina M Schreiber
(74) *Attorney, Agent, or Firm* — Greenblum & Bernstein, P.L.C.

(57) ABSTRACT

To provide a change of sound in response to a player's operation that is close to the change of sound of real hi-hat cymbals. A hi-hat cymbal sound generation apparatus according to the present invention includes an input part, a recording part, a trigger part and a sound volume control part. The input part acquires state information and vibration information. The recording part records data on a foot close sound, data on a foot open sound, and data on a hit sound in each state indicated by the state information. The trigger part checks whether the vibration indicated by the vibration information falls within a predetermined range in which a sound generation procedure is to be started, and starts sound generation procedures for at least all the hit sounds when the trigger part determines that the vibration falls within the range in which a sound generation procedure is to be started.

13 Claims, 13 Drawing Sheets

(56) References Cited

U.S. PATENT DOCUMENTS

| | | | | |
|---|---|---|---|---|
| 8,946,536 | B2 * | 2/2015 | Field | G10H 3/146 84/723 |
| 2005/0150349 | A1 * | 7/2005 | Susami | G10H 3/146 84/299 |
| 2006/0275631 | A1 * | 12/2006 | Rosenberg | G10D 13/021 429/8 |
| 2008/0034946 | A1 * | 2/2008 | Aimi | G10H 3/146 84/604 |
| 2009/0183627 | A1 * | 7/2009 | Susami | G10H 1/06 84/735 |
| 2010/0180755 | A1 * | 7/2010 | Copeland | G10H 1/0066 84/622 |
| 2012/0118130 | A1 * | 5/2012 | Field | G10H 3/146 84/730 |
| 2013/0145923 | A1 * | 6/2013 | Susami | G10H 1/348 84/622 |
| 2017/0263230 | A1 * | 9/2017 | Takehisa | G10H 1/348 |
| 2019/0051271 | A1 * | 2/2019 | Takehisa | G10D 13/024 |
| 2019/0156798 | A1 * | 5/2019 | Motohashi | G10D 13/065 |
| 2019/0180727 | A1 * | 6/2019 | Motohashi | G10H 3/146 |

* cited by examiner

HI-HAT CYMBAL SOUND GENERATION APPARATUS, HI-HAT CYMBAL SOUND GENERATION METHOD, AND RECORDING MEDIUM

TECHNICAL FIELD

The present invention relates to a hi-hat cymbal sound generation apparatus that generates a hi-hat cymbal sound, a hi-hat cymbal sound generation method, and a recording medium.

BACKGROUND ART

Prior arts disclosed in Japanese Patent Application Laid-Open Nos. 2005-195981 (Patent Literature 1) and 2009-80444 (Patent Literature 2) are known arts for generating a pseudo hi-hat cymbal sound.

SUMMARY OF THE INVENTION

These arts have a problem that some players feel that the change of sound in response to their operation is different from that of the real hi-hat cymbals.

In view of this, an object of the present invention is to provide a change of sound in response to a player's operation that is close to the change of sound of real hi-hat cymbals.

A hi-hat cymbal sound generation apparatus according to the present invention generates a sound of hi-hat cymbals based on information on an operation to a top pad, which corresponds to a top cymbal, and a bottom pad, which corresponds to a bottom cymbal, and the top pad and the bottom pad are attached to a hi-hat stand with a pedal. A distance between the top pad and the bottom pad is capable of being changed by an operation of the pedal. State information is information that indicates which of a predetermined number of states a state is, and the state is determined by the distance between the top pad and the bottom pad. Of the states, a state in which the top pad and the bottom pad are closest to each other is designated as a close state. The hi-hat cymbal sound generation apparatus comprises an input part, a recording part, a trigger part, and a sound volume control part. The input part acquires at least the state information and vibration information, which is information on a vibration of the top pad. The recording part records data on a foot close sound that corresponds to a sound in the close state generated by the top cymbal and the bottom cymbal coming into contact with each other in response to an operation of the pedal, data on a foot open sound that corresponds to a sound in a state other than the close state generated by the top cymbal and the bottom cymbal coming into contact with each other in response to an operation of the pedal, and data on the predetermined number of hit sounds that correspond to sounds generated by hitting in the states indicated by the state information. The trigger part checks whether the vibration indicated by the vibration information falls within a predetermined range in which a sound generation procedure is to be started, and starts sound generation procedures for at least all the hit sounds when the trigger part determines that the vibration falls within the range in which a sound generation procedure is to be started. The sound volume control part generates an output signal by controlling a sound volume of each sound whose sound generation procedure is being performed based on the current state information and information on a change of the distance between the top pad and the bottom pad.

The hi-hat cymbal sound generation apparatus according to the present invention starts the sound generation procedures for at least all the hit sounds if a vibration falls within the range in which a sound generation procedure is to be started. That is, all the sounds are generated with the respective envelopes with the respective attacks being synchronized. The output signal responsive to the change of the state is then generated by controlling the sound volume of each sound. In other words, the hi-hat cymbal sound generation apparatus starts the sound generation procedures for at least all the sounds that can be caused by a vibration only when the vibration is caused by the player, and does not start any sound generation procedure but selects sound by controlling the sound volume when no vibration is caused by the player. Through this process, the hi-hat cymbal sound generation apparatus can provide a change of sound closer to that of the real hi-hat cymbals than prior art.

DETAILED DESCRIPTION OF THE EMBODIMENTS

Figure 1:
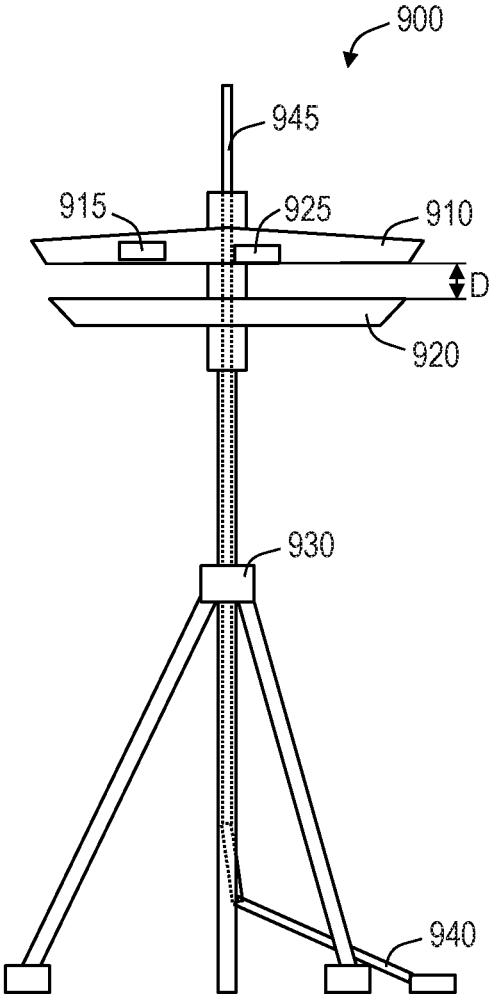
FIG. 1 is a diagram showing a configuration of electronic hi-hat cymbals.

In the following, embodiments of the present invention will be described in detail. Components having the same function are denoted by the same reference numeral, and redundant description thereof will be omitted.

First Embodiment

<Introduction>

FIG. 1 shows a configuration of electronic hi-hat cymbals. Electronic hi-hat cymbals 900 include a hi-hat stand 930 with a pedal 940, and a top pad 910 corresponding to a top cymbal and a bottom pad 920 corresponding to a bottom cymbal attached to the hi-hat stand 930. The top pad 910 is fixed to a shaft 945 of the hi-hat stand 930, and the shaft 945 is coupled to the pedal 940 at one end thereof. In response to an operation of the pedal 940, the shaft 945 moves up and down, and therefore, the top pad 910 also moves up and down. More specifically, the top pad 910 moves down when the pedal 940 is pressed, and moves up when the pedal 940 is released. Therefore, a distance D between the top pad 910 and the bottom pad 920 can be changed by an operation of the pedal 940. The top pad 910 is provided with a vibration sensor 915 that detects a vibration, and a distance sensor 925 that detects the distance D between the top pad 910 and the bottom pad 920. The vibration sensor and the distance sensor may be arranged at different locations.

A predetermined number N of states are previously set as states that depend on the distance D between the top pad 910 and the bottom pad 920. State information is information that indicates which of those states is relevant. N denotes an integer equal to or greater than 3. Of these states, a state where the top pad 910 and the bottom pad 920 are closest to each other is referred to as a close state, a state where the pads are farthest from each other is referred to as an open state, and the other states are referred to as a half-open state. The number N of the states can be the number of different sounds discernible to the human ear that are caused by the change of the distance D. The way of division into the N states depending on the distance D can be determined based on the difference in sound of the real hi-hat cymbals. For example, N=8 can be set, and the distance D can be divided at narrower intervals at the close state and half-open states closer to the close state and at wider intervals at half-open states closer to the open state.

<Configuration and Characteristics of Hi-Hat Cymbal Sound Generation Apparatus>

Figure 2:
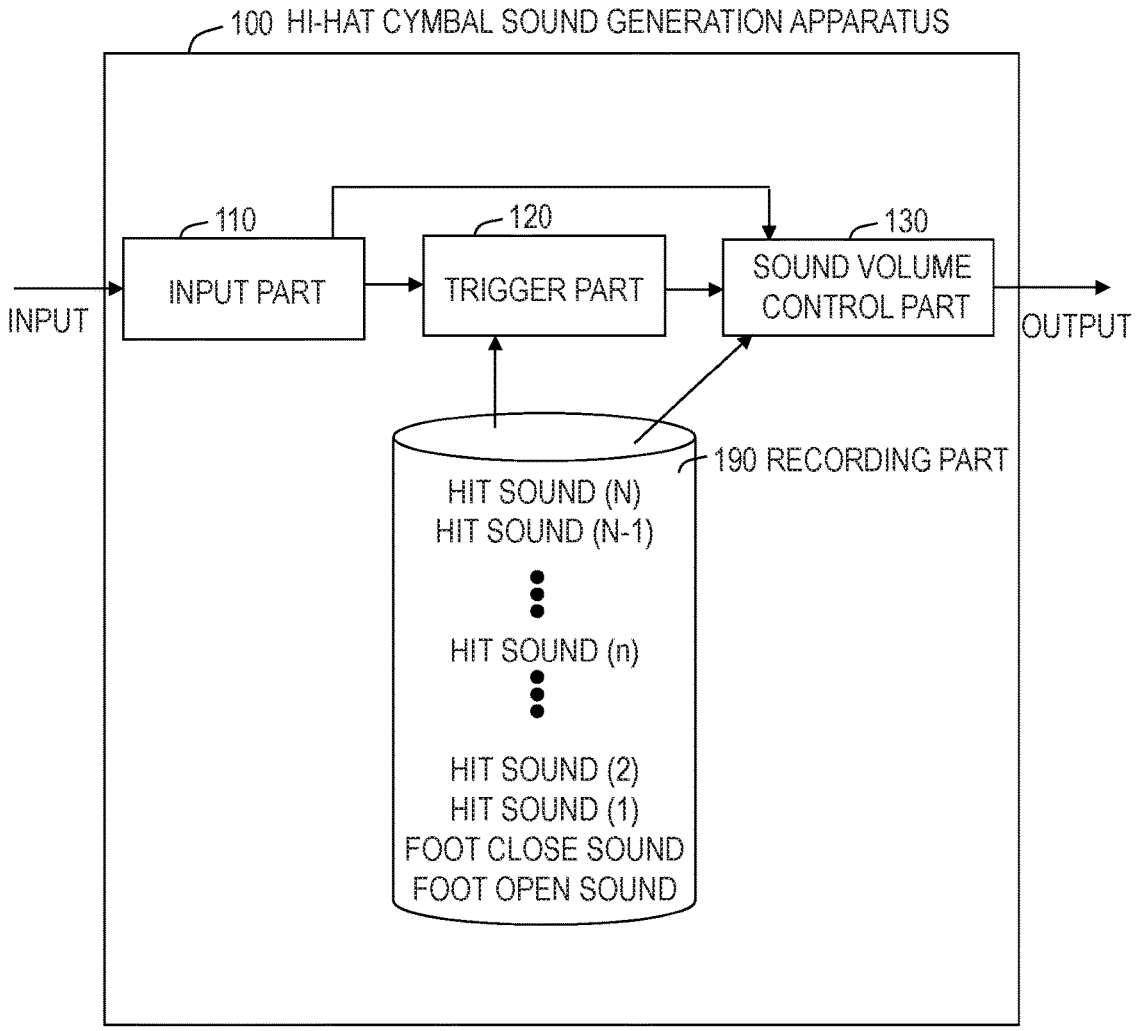
FIG. 2 is a diagram showing an example of a functional configuration of a hi-hat cymbal sound generation apparatus according to the present invention.
Figure 3:
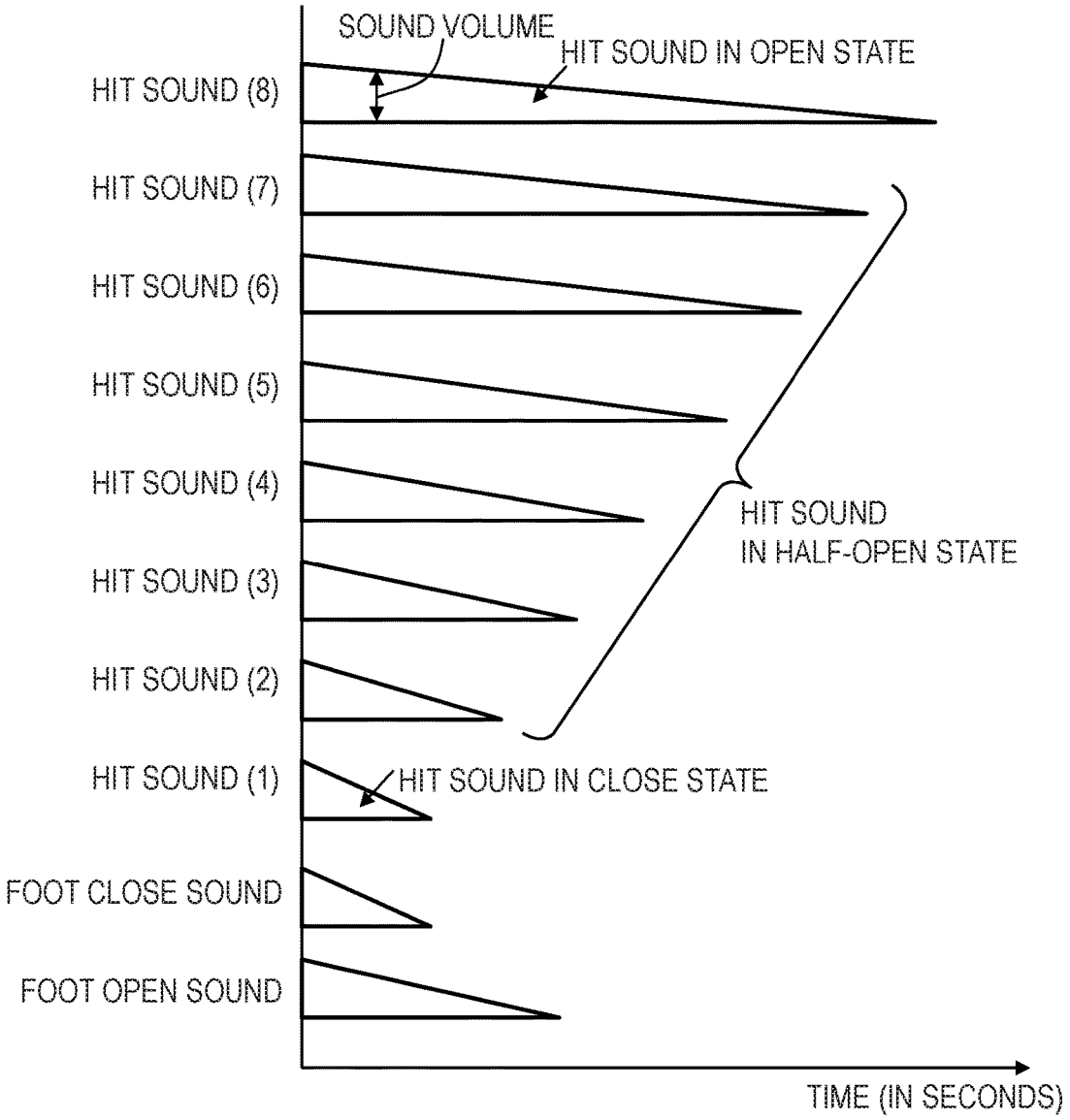
FIG. 3 shows a graphical image of sound data recorded in a recording part 190.
Figure 4:
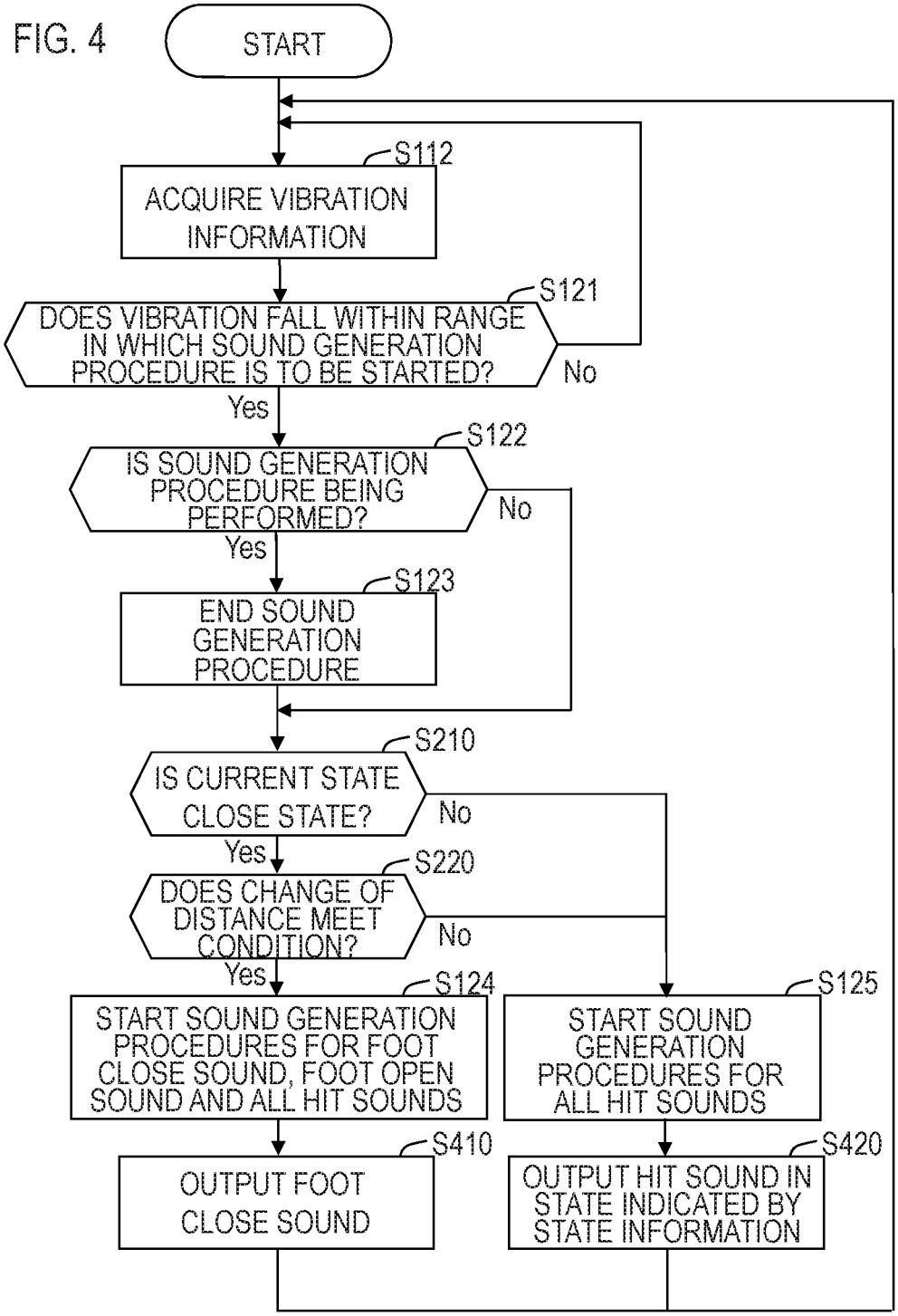
FIG. 4 is a diagram showing an example of a flow of a process in which vibration information is acquired and a sound generation procedure is started.
Figure 5:
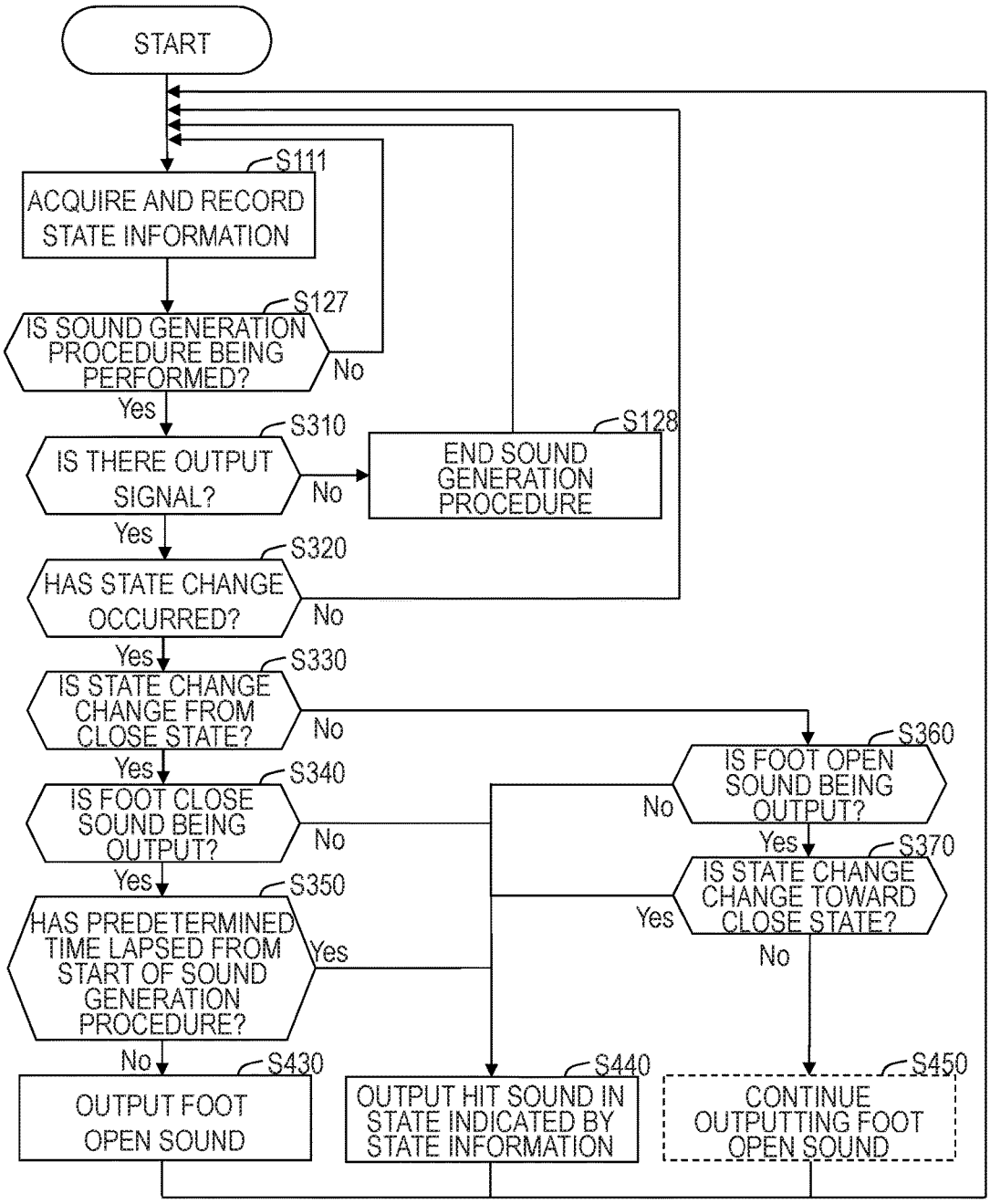
FIG. 5 is a diagram showing an example of a flow of a process in which state information is acquired and a sound generation procedure is being performed.

FIG. 2 shows an example of a functional configuration of a hi-hat cymbal sound generation apparatus according to the present invention. A hi-hat cymbal sound generation apparatus 100 includes an input part 110, a recording part 190, a trigger part 120, and a sound volume control part 130. FIG. 3 shows a graphical image of sound data recorded in the recording part 190. FIG. 4 shows an example of a flow of a process in which vibration information is acquired and a sound generation procedure is started. FIG. 5 shows an example of a flow of a process in which state information is acquired and a sound generation procedure is being performed.

The input part 110 acquires at least state information and vibration information, which is information on a vibration of the top pad (S111, S112). The input part 110 can repeat the processing. For example, the input part 110 may perform the processing every 5 ms, every 10 ms, or every 20 ms. The state information and the vibration information may be acquired at the same time, or may be acquired at different times at different intervals. For example, the vibration information may be acquired every 2 ms, and the state information may be acquired every 5 ms or 10 ms. The acquisition of the state information and the vibration information may be achieved by acquiring the state information and the vibration information themselves, or by acquiring other information from which the state information and the vibration information can be derived and deriving the state information and the vibration information from the information in the input part 110. For example, the input part 110 may acquire the state information by acquiring measurement data on the distance D between the top pad 910 and the bottom pad 920 and determining which state is the current state based on the measurement data.

The hi-hat cymbal sound generation apparatus 100 may derive information about the change of the distance D between the top pad 910 and the bottom pad 920 from current and past state information. In that case, information about the change of the distance D can be derived from only the least information acquired by the input part 110. Alternatively, the information about the change of the distance D may be derived from current and past measurement data on the distance D between the top pad 910 and the bottom pad 920 or from other information. The present invention is not limited to these, and the information about the change of the distance D may be obtained in other ways using information acquired by the input part 110.

The recording part 190 records data on a foot close sound, which corresponds to a sound in the close state that is generated when the top cymbal and the bottom cymbal come into contact with each other in response to operation of the pedal, data on a foot open sound, which corresponds to a sound in a state other than the close state that is generated when the top cymbal and the bottom cymbal come into contact with each other in response to operation of the pedal, and data on the predetermined number of hit sounds, which correspond to sounds generated when the cymbals are hit in states indicated by the state information. In other words, the foot close sound corresponds to a sound that is generated by the top cymbal hitting the bottom cymbal in response to operation of the pedal. The foot open sound corresponds to a sound that is generated when the top cymbal is taken off the bottom cymbal immediately after the foot close sound is generated. The hit sounds correspond to sounds that are generated when the top cymbal is hit with a stick. The expression "sound that corresponds to a sound" means not only the real sound of hi-hat cymbals but also a manipulated sound or a pseudo sound. The term "data" is not limited to digital data on the real sound but may be digital data on a pseudo sound or data on a characteristic quantity used for reproduction of a sound. The recording part 190 may record a plurality of sets of data on the foot close sound, data on the foot open sound and data on hit sounds (1) to (N) in association with vibrations indicated by the vibration information. In that case, for example, the intensity of the vibration or the sound volume, which depends on the intensity of the vibration, can be divided into a plurality of phases, and a different set of data on the foot close sound, data on the foot open sound and data on the hit sounds (1) to (N) can be recorded for each phase. In FIG. 3, the horizontal axis indicates time, and the triangle indicating each sound is a graphical image of an envelope of the sound. A triangle that is short in the horizontal direction means that the sound disappears (tends to attenuate) in a short time. The height of each triangle represents the sound volume. The hit sound (1) represents a hit sound in the close state, and the hit sound (8) represents a hit sound in the open state. The hit sounds (2) to (7) represent hit sounds in half-open states. In this example, N, which is the "predetermined number of states", is 8.

The trigger part 120 checks whether the vibration indicated by the vibration information fall within a predetermined range in which a sound generation procedure is to be started (S121). If it is determined that the vibration falls within the range in which the sound generation procedure is to be started, the trigger part 120 starts sound generation procedures for at least all the hit sounds (S124, S125). If a plurality of sets of data on the foot close sound, data on the foot open sound and data on the hit sounds (1) to (8) is recorded in the recording part 190, the trigger part 120 can select a set that corresponds to the intensity of the vibration or the sound volume and start the sound generation procedure. If the trigger part 120 determines that a vibration indicated by new vibration information acquired during the sound generation procedure falls within the predetermined range in which a sound generation procedure is to be started (S121, S122), the trigger part 120 ends the current sound generation procedure (S123) and starts a new sound generation procedure (S124, S125). The expression "a predetermined range in which a sound generation procedure is to be started" means a range in which the relevant vibration is estimated to be caused by a player's intentional operation to produce a sound. The "predetermined range in which a sound generation procedure is to be started" can be appropriately set by considering the type, sensitivity, position of the vibration sensor. Even after the sound generation procedure is started (S124, S125), Steps S112 and S121 are repeated to detect a new vibration.

The sound volume control part 130 generates an output signal by controlling the sound volume of each sound being generated according to the current state information and the information about the change of the distance D between the top pad 910 and the bottom pad 920. Although, once a sound generation procedure is started, reproduction of at least all the hit sounds is started in the hi-hat cymbal sound generation apparatus 100, a sound whose sound volume is zero is not included in the output signal. The sound volume control part 130 generates the output signal by setting the sound volume of a particular sound at a value other than zero. FIGS. 4 and 5 will be described in detail later.

When changing sounds in response to a change of the distance D, sounds may be changed instantly or by cross-fade. The "cross-fade" refers to gradually increasing the volume of the new sound while gradually decreasing the volume of the previous sound. Cross-fade allows sounds to be more naturally changed. The duration of the cross-fade can be determined according to the rate of the change of states. For example, two cross-fade durations can be set, and one of the cross-fade durations can be selected based on whether the information about the change of the distance D meets a predetermined condition of a quick change. For example, the cross-fade duration may be 10 ms or 20 ms for a quick change and may be 50 ms or 100 ms for a slow change. The sound volume control part 130 controls the sound volume so that the sound volume of the output signal after the change continuously attenuates from the sound volume before the change. When there is no output signal after the change, the sound volume control part 130 may end the sound generation procedure (S310, S128) or continue outputting the sound before the change (S440).

When the vibration falls within the range in which a sound generation procedure to be started, the hi-hat cymbal sound generation apparatus 100 starts sound generation procedures for at least all the hit sounds. More specifically, all the sounds are generated with the respective envelopes with the respective attacks being synchronized. The output signal responsive to the change of the state is then generated by controlling the sound volume of each sound. In other words, the hi-hat cymbal sound generation apparatus 100 starts the sound generation procedures for at least all the sounds that can be caused by a vibration only when the vibration is caused by the player, and does not start any sound generation procedure but selects sound by controlling the sound volume when no vibration is caused by the player. Through this process, the hi-hat cymbal sound generation apparatus 100 can provide a change of sound closer to that of the real hi-hat cymbals than prior art.

<Specific Example of Process Performed by Hi-Hat Cymbal Sound Generation Apparatus>

Figure 6:
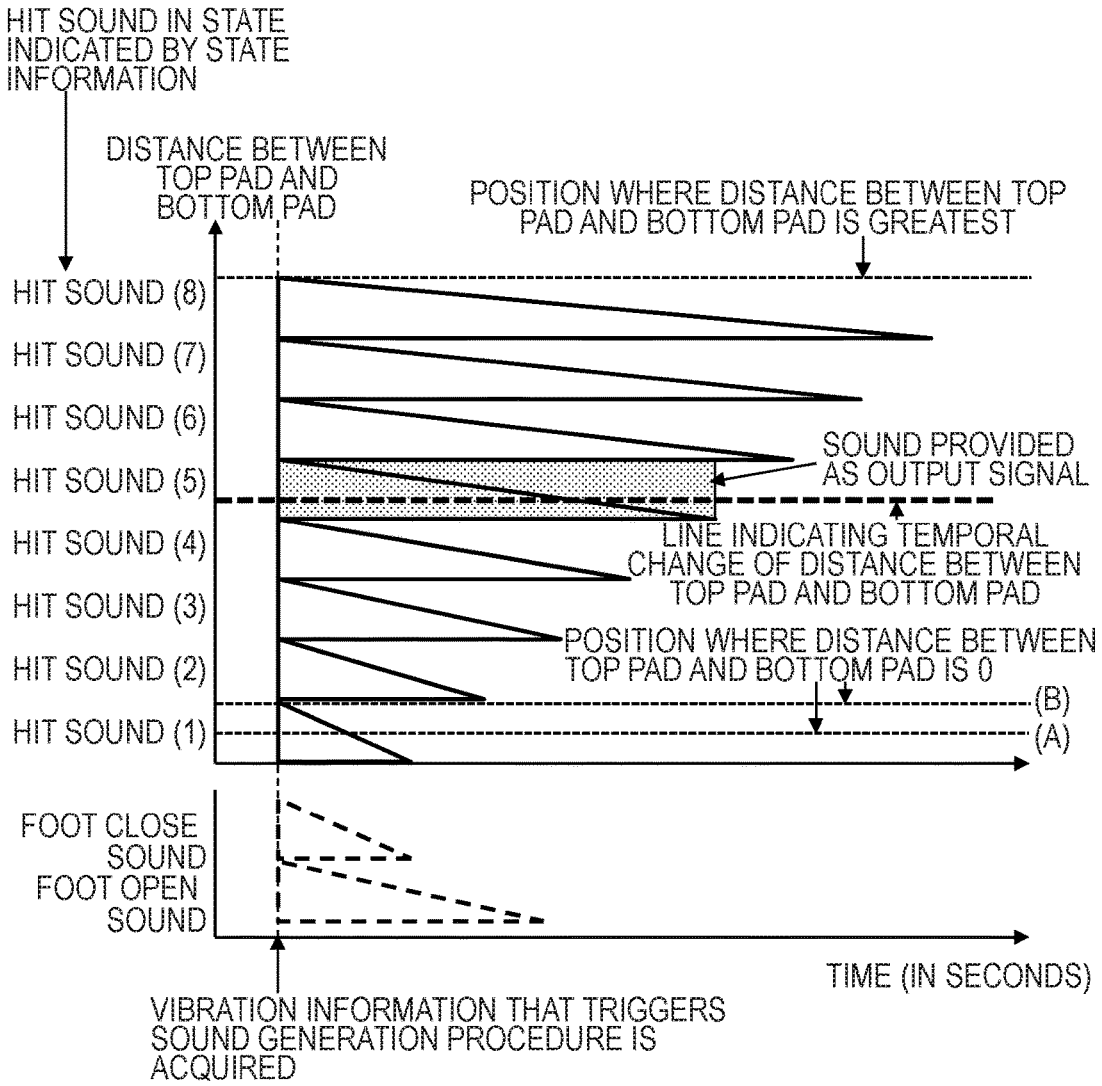
FIG. 6 shows a graphical image of a process performed by a sound volume control part 130 when no state change occurs.
Figure 7:
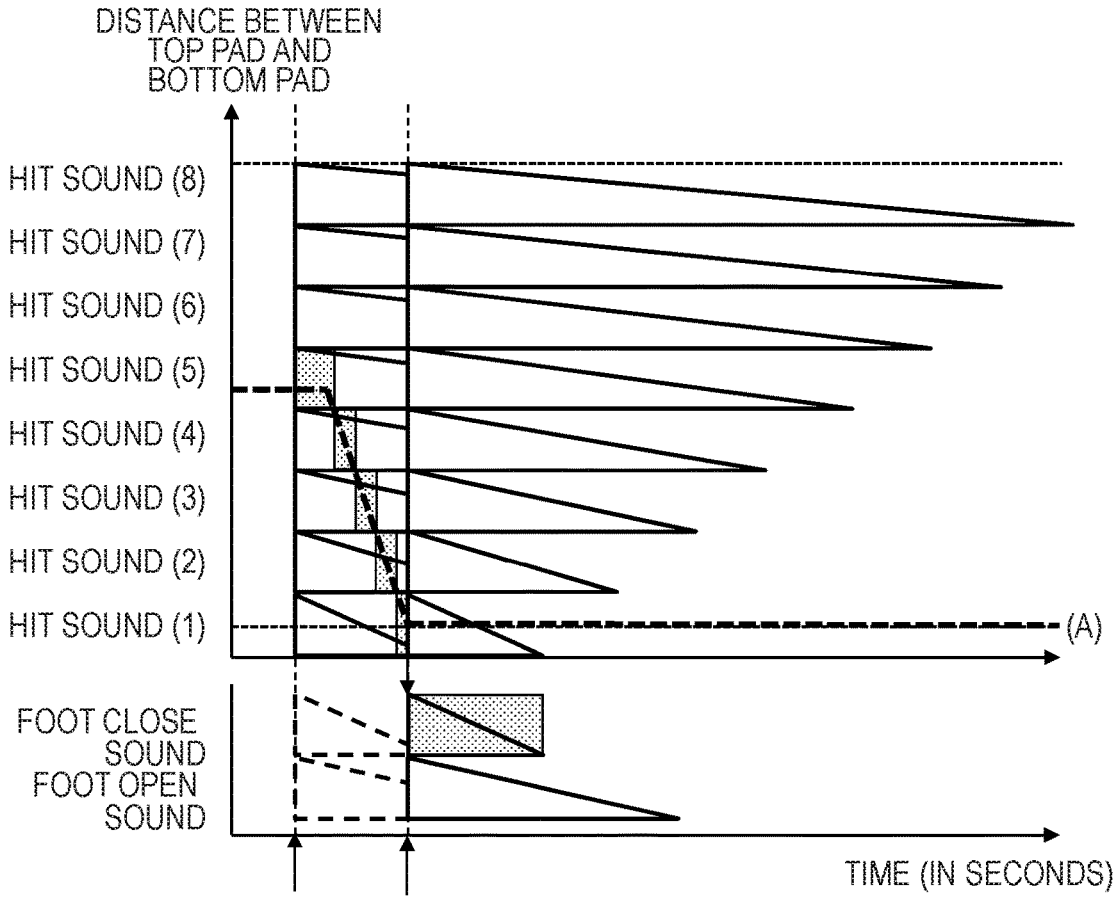
FIG. 7 shows a graphical image of a first process performed by the sound volume control part 130 when the state changes from a half-open state to a close state.
Figure 8:
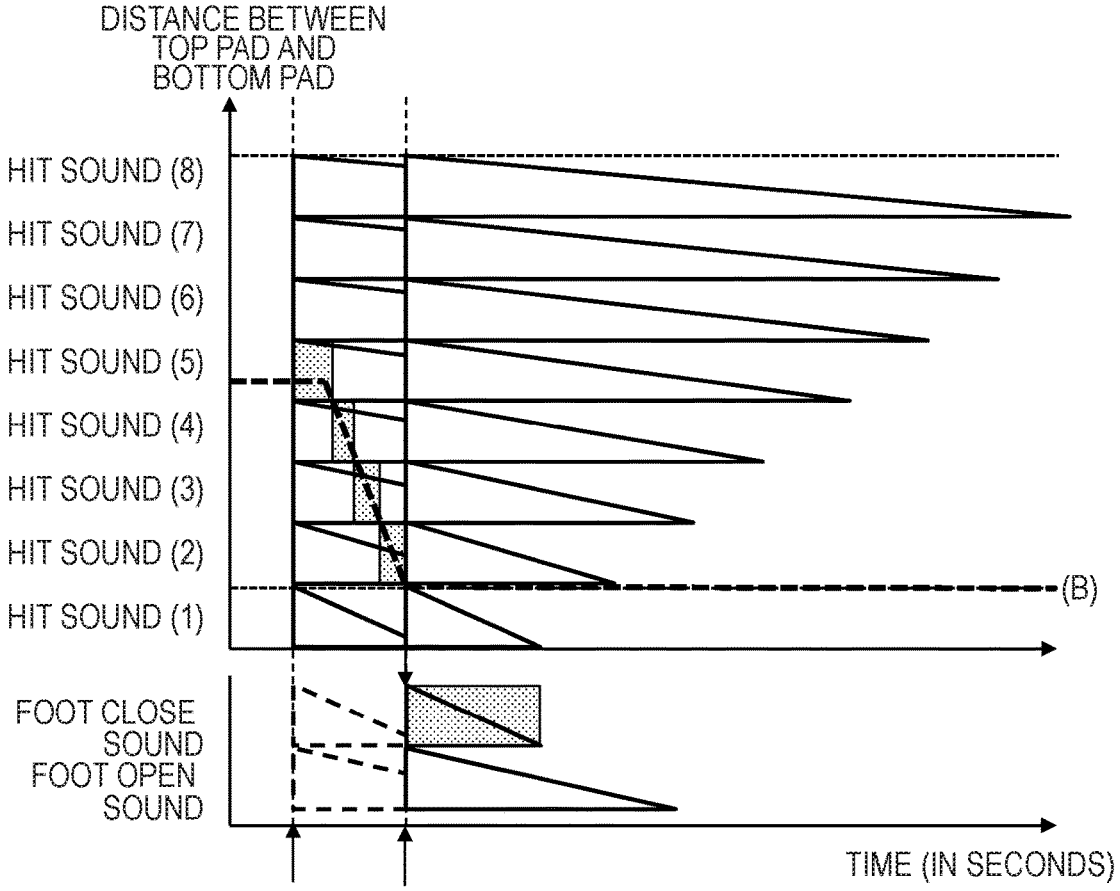
FIG. 8 shows a graphical image of a second process performed by the sound volume control part 130 when the state changes from a half-open state to the close state.
Figure 9:
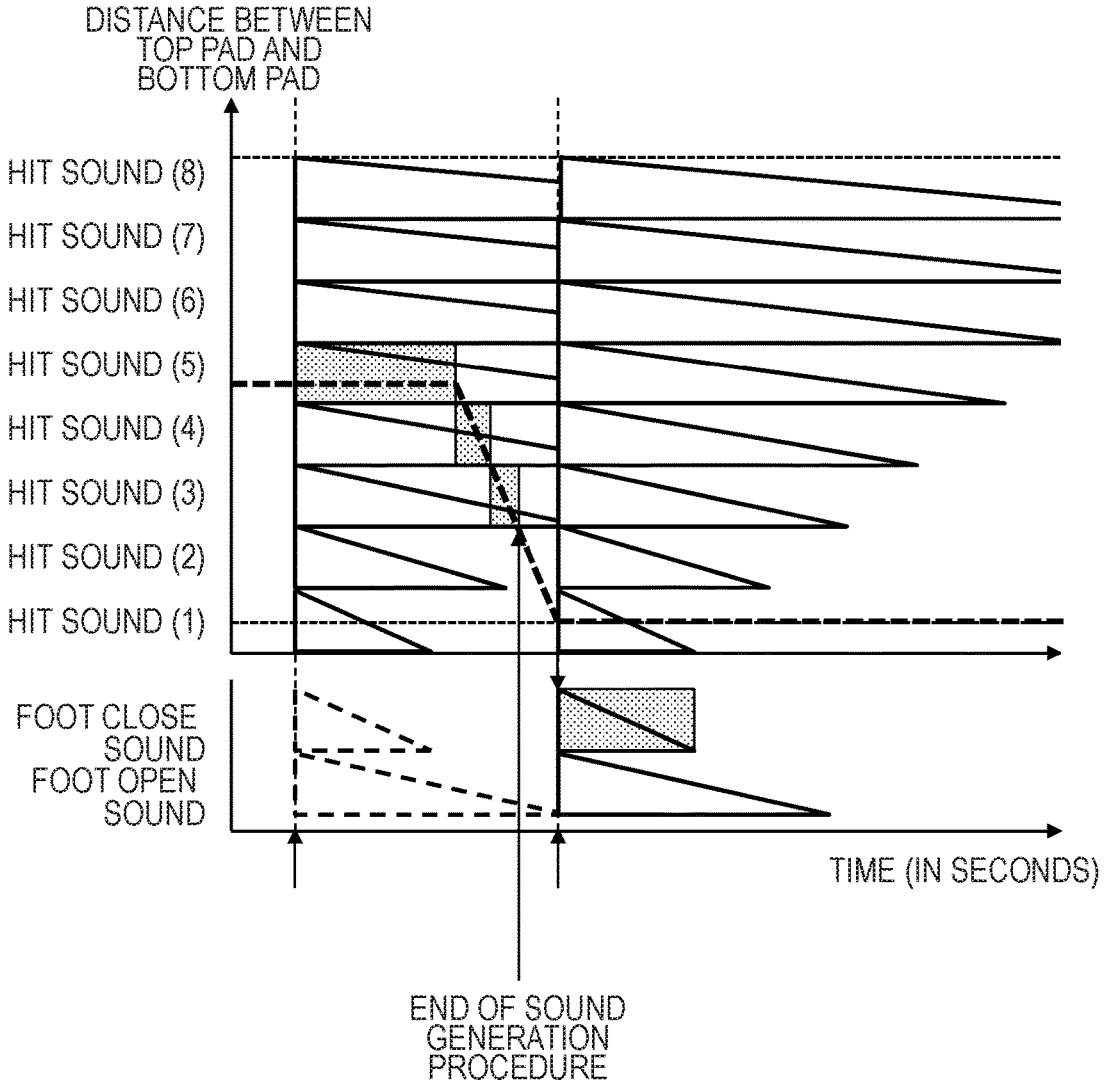
FIG. 9 shows a graphical image of a third process performed by the sound volume control part 130 when the state changes from a half-open state to the close state.
Figure 10:
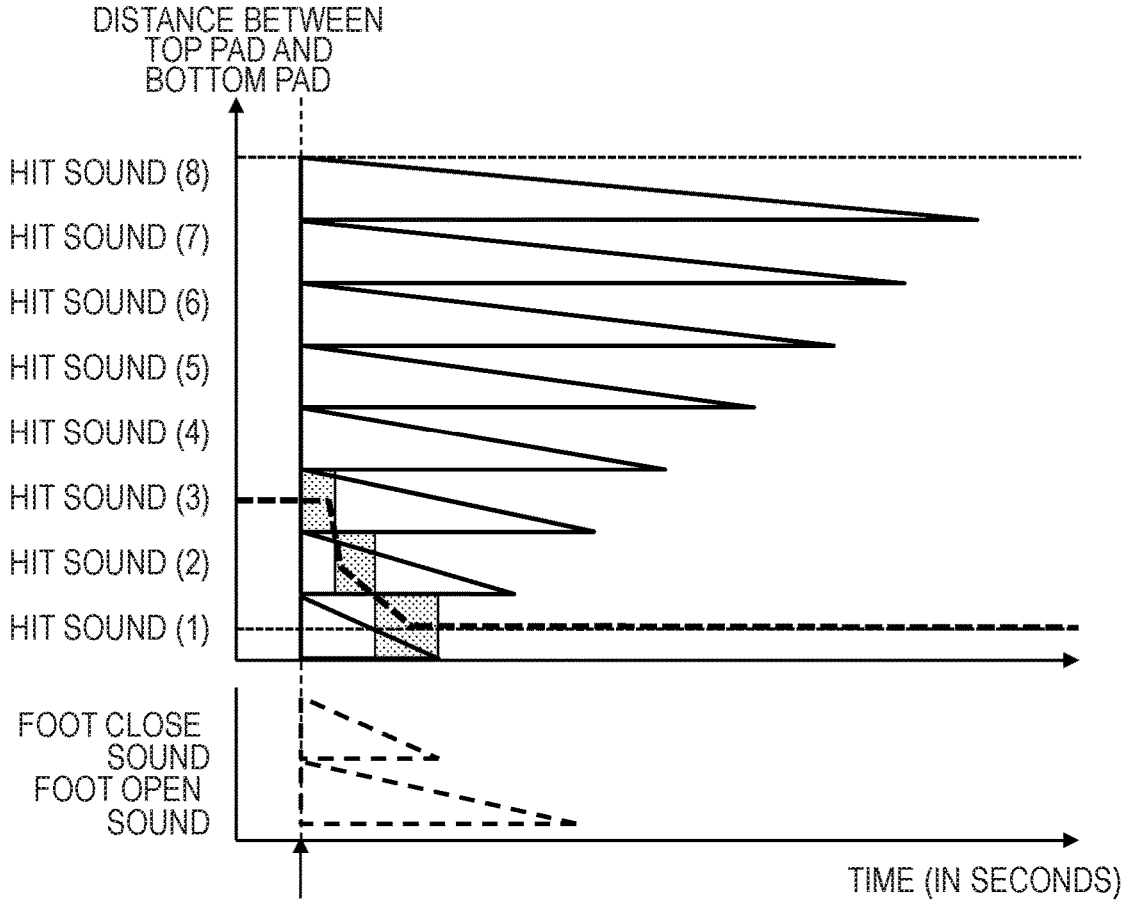
FIG. 10 shows a graphical image of a fourth process performed by the sound volume control part 130 when the state changes from a half-open state to the close state.
Figure 11:
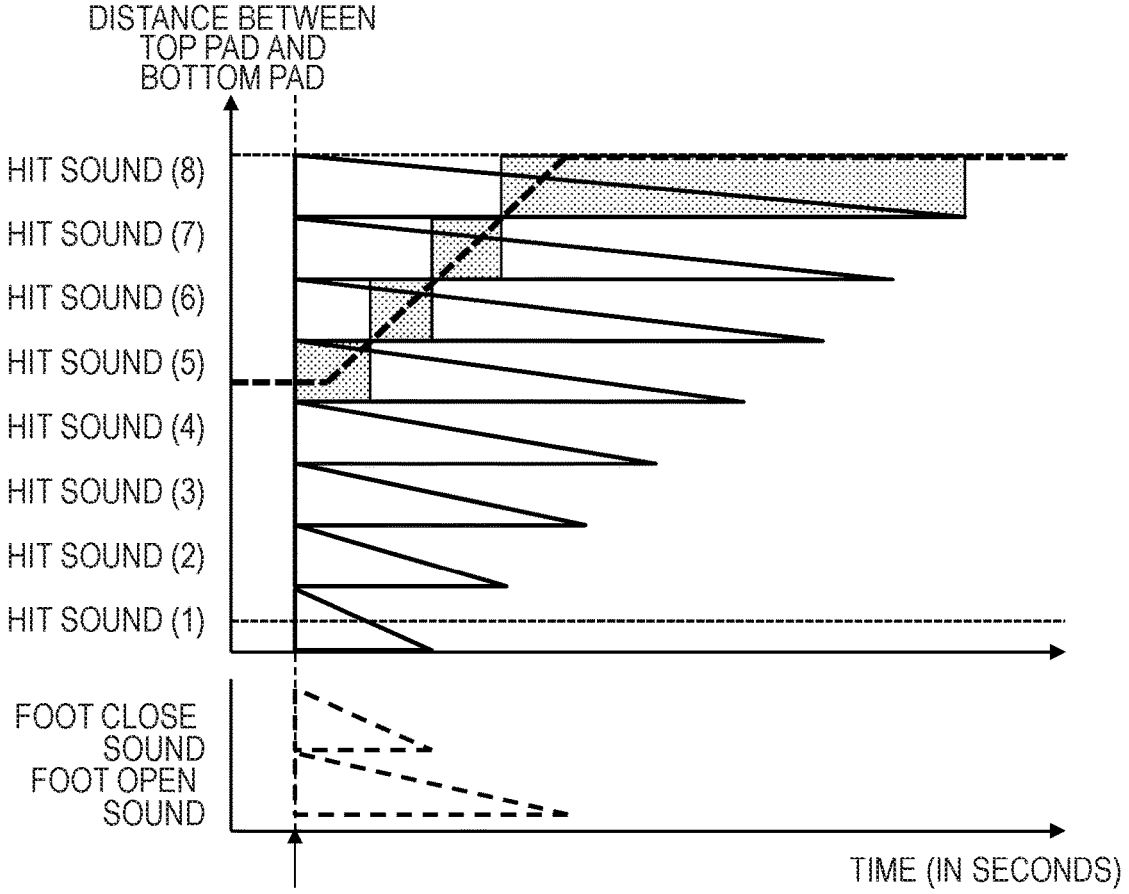
FIG. 11 shows a graphical image of a process performed by the sound volume control part 130 when the state changes from a half-open state to an open state.
Figure 12:
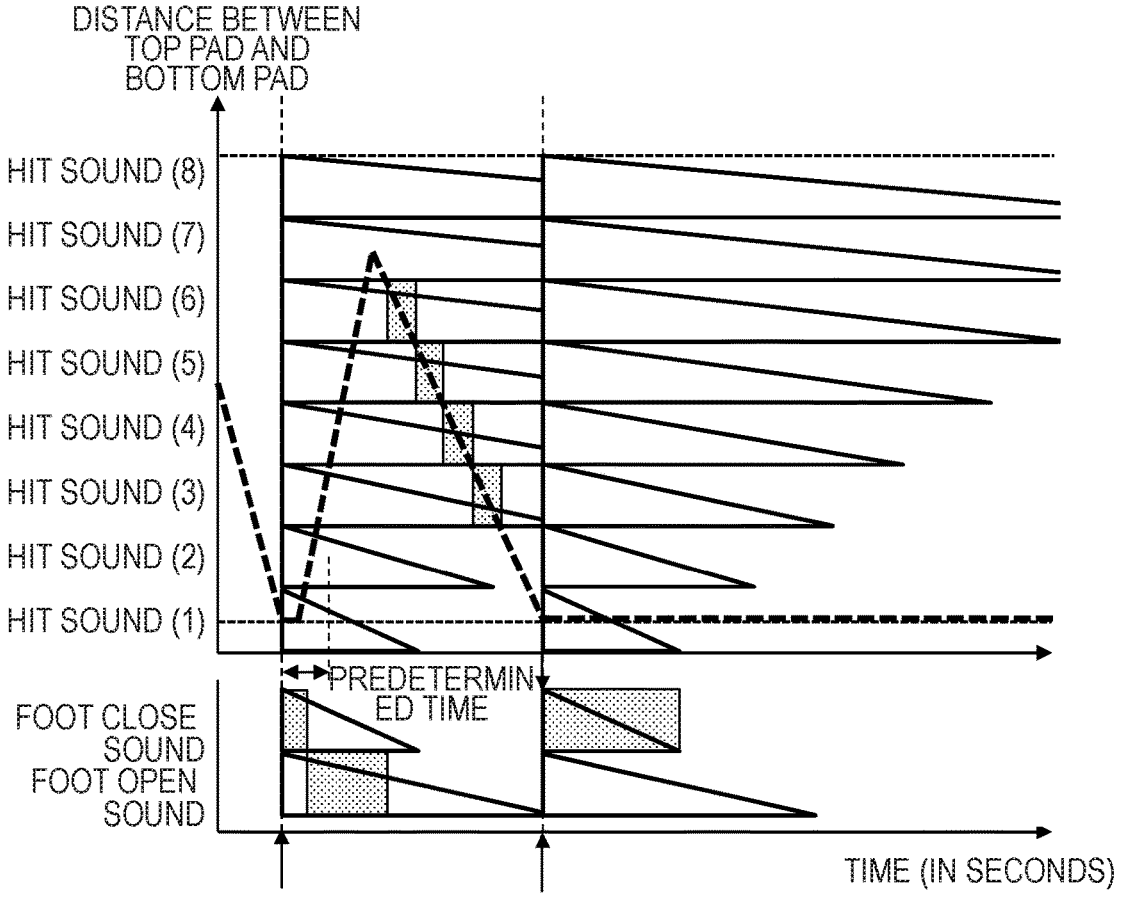
FIG. 12 shows a graphical image of a process performed by the sound volume control part 130 when a foot open sound is output following a foot close sound, and then the foot close sound is output again.
Figure 13:
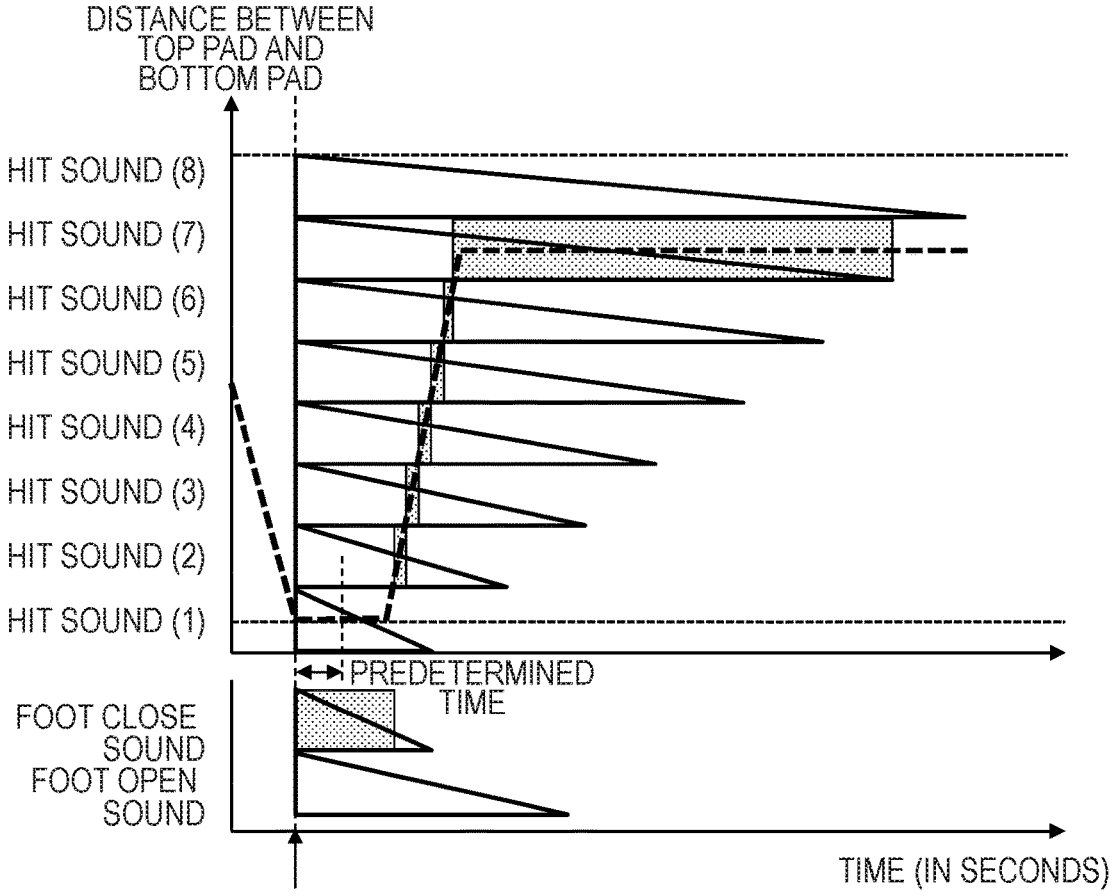
FIG. 13 shows a graphical image of a procedure performed by the sound volume control part 130 when a hit sound is output following the foot close sound.

FIG. 6 shows a graphical image of a process performed by the sound volume control part 130 when no state change occurs. With reference to FIG. 6, what the graphical image of the process performed by the sound volume control part 130 means will also be described. FIG. 7 shows a graphical image of a first process performed by the sound volume control part 130 when the state changes from a half-open state to the close state. FIG. 8 shows a graphical image of a second process performed by the sound volume control part 130 when the state changes from a half-open state to the close state. FIG. 9 shows a graphical image of a third process performed by the sound volume control part 130 when the state changes from a half-open state to the close state. FIG. 10 shows a graphical image of a fourth process performed by the sound volume control part 130 when the state changes from a half-open state to the close state. FIG. 11 shows a graphical image of a process performed by the sound volume control part 130 when the state changes from a half-open state to the open state. FIG. 12 shows a graphical image of a process performed by the sound volume control part 130 when the foot open sound is output following the foot close sound, and then the foot close sound is output again. FIG. 13 shows a graphical image of a process performed by the sound volume control part 130 when a hit sound is output following the foot close sound.

Next, Step S210 and the following steps in FIG. 4 will be described. At the time for the trigger part 120 to start a sound generation procedure, the sound volume control part 130 checks whether the current state is the close state (S210). If the answer is Yes, it is checked whether the change of the distance D between the top pad 910 and the bottom pad 920 meets a predetermined condition (S220). If the current state is not the close state (No in S210), or if the current state is the close state but the change of the distance between the top pad and the bottom pad does not meet the predetermined condition (if Yes in S210 but No in S220), the trigger part 120 starts the sound generation procedures for all the hit sounds (S125). If a plurality of sets of data on the foot close sound, data on the foot open sound and data on the hit sounds (1) to (8) is recorded in the recording part 190, the trigger part 120 can select a set that corresponds to the intensity of the vibration or the sound volume and start the sound generation procedures for all the hit sounds. The sound volume control part 130 controls the sound volume so that the hit sound in the state indicated by the state information is provided as the output signal (S420). If the current state is the close state, and the change of the distance D between the top pad 910 and the bottom pad 920 meets the predetermined condition (if Yes in S210 and Yes in S220), the trigger part 120 starts the sound generation procedures for the foot close sound, the foot open sound and all the hit sounds (S124). If a plurality of sets of data on the foot close sound, data on the foot open sound and data on the hit sounds (1) to (8) is recorded in the recording part 190, the trigger part 120 can select a set that corresponds to the intensity of the vibration or the sound volume and start the sound generation procedures for the foot close sound, the foot open sound and all the hit sounds. The sound volume control part 130 controls the sound volume so that the foot close sound is provided as the output signal (S410). If the initial sound is a hit sound, neither the foot close sound nor the foot open sound is provided as the output signal until a vibration falling within the range in which a new sound generation procedure is to be started is detected. Therefore, in Step S125, the trigger part 120 does not need to perform the sound generation procedures for the foot close sound and the foot open sound. However, in Step S125, the trigger part 120 can start the sound generation procedures for the foot close sound and the foot open sound.

The "time to start a sound generation procedure" means a time when the initial sound recorded in the recording part 190 can be reproduced. The "predetermined condition" is a condition that the change of the distance D before the sound generation procedure is started is has a momentum (at high rate). This is because the foot close sound is generated when the player presses the pedal 940 down hard to make the top pad 910 hit the bottom pad 920. In other words, the expression "the change of the distance between the top pad and the bottom pad meets a predetermined condition" means that a condition is met that a vibration that falls within a predetermined range in which a sound generation procedure is to be started is caused only by a pedal operation. The determination of whether the "predetermined condition" is met is to check whether the change of the distance D has a momentum, so that the information on the change of the distance D needs to be acquired at short intervals of 5 ms, 10 ms or 15 ms, for example.

Next, FIG. 5 will be described. Once the input part 110 acquires the state information (S111), the hi-hat cymbal sound generation apparatus 100 checks whether a sound generation procedure is being performed (S127). If a sound generation procedure is being performed (Yes in S127), the hi-hat cymbal sound generation apparatus 100 checks whether there is an output signal (S310), and ends the sound generation procedure (S128) if there is no output signal. If there is an output signal, the hi-hat cymbal sound generation apparatus 100 checks whether there has been a state change (S320), and returns to Step S111 if there has not been a state change. The loop that starts from S111 can be performed at regular intervals (every 5 ms or every 10 ms, for example). At the times other than the time for the trigger part 120 to start a sound generation procedure, the sound volume control part 130 processes the sound volume as described below.

If there has been a state change (Yes in S320), the sound volume control part 130 checks whether the state change is a change from the close state (S330). If the answer in S330 is Yes, the sound volume control part 130 checks whether the foot close sound is being output (S340). If the answer in S340 is Yes, the sound volume control part 130 checks whether a predetermined time has lapsed from the sound generation procedure (S350). By performing these checks, the sound volume control part 130 controls the sound volume as follows.

(1) If the state change is a change from the close state (Yes in S330), the sound volume control part 130

(1-1) controls the sound volume so that the hit sound in the state indicated by the state information after the change is provided as the output signal (S440) when the output signal before the change is the hit sound in the close state (when No in S340), (1-2) controls the sound volume so that the foot open sound is provided as the output signal (S430) when the output signal before the change is the foot close sound and the predetermined time has not lapsed from the start of the sound generation procedure (Yes in S340 and No in S350), and (1-3) controls the sound volume so that the hit sound in the state indicated by the state information after the change is provided as the output signal (S440) when the output signal before the change is the foot close sound as and the predetermined time has lapsed from the start of the sound generation procedure (Yes in S340 and Yes in S350).

If the answer in S330 is No, the sound volume control part 130 checks whether the foot open sound is being output (S360). If the answer in S360 is Yes, the sound volume control part 130 checks whether the state change is a change toward the close state (S370). By performing these checks, the sound volume control part 130 controls the sound volume as follows.

(2) If the state change is a change from a state other than the close state (No in S330), the sound volume control part 130

(2-1) controls the sound volume so that the hit sound in the state indicated by the state information after the change is provided as the output signal (S440) if the state after the change is at least not silence when the output signal before the change is the hit sound in the state indicated by the state information (No in S360), (2-2) continues providing the foot open sound as the output signal (S450) when the output signal before the change is the foot open sound and the change of the state indicated by the state information is not a change toward the close state (Yes in S360 and No in S370), and (2-3) controls the sound volume so that the hit sound in the state indicated by the state information after the change is provided as the output signal (S440) if the state after the change is at least not silence when the output signal before the change is the foot open sound and the change of the state indicated by the state information is a change toward the close state (Yes in S360 and Yes in S370).

The expression "the state after the change is not silence" means that there is the hit sound in the state indicated by the state information after the change. If it sounds unnatural when the state suddenly changes to silence, the sound before the change can continue being output. More specifically, in Step S440, if there is no hit sound in the state indicated by the state information after the change under a predetermined condition, the sound volume control part 130 can continue outputting the hit sound before the change. The "predetermined condition" is a condition that the state after the change is the close state or the half-open state that is the closest to the close state, for example, and the way of controlling the sound volume can be appropriately determined so that the sound naturally attenuates. Furthermore, in S450, the foot open sound continues being provided as the output signal. This can be regarded as no state change. Therefore, the sound volume control part 130 can simply continue the current processing. Furthermore, a change from a state other than the close state may be a change to the close state. If a change to the close state has occurred, a vibration that falls within the predetermined range in which a sound generation procedure is to be started may be detected (S112, S121). If a vibration that falls within the range in which a sound generation procedure is to be started is detected, the trigger part 120 ends the current sound generation procedure (S122, S123), and starts a new sound generation procedure (S124, S125). Therefore, the sound volume control part 130 performs the process (FIG. 4) at the time for the trigger part 120 to start a sound generation procedure. That is, when the top pad 910 comes into contact with the bottom pad 920 slowly enough that no sound generation procedure is started, a state change to the close state occurs and the process (FIG. 5) at a time other than the time for the trigger part 120 to start a sound generation procedure occurs. In that case, the sound volume control part 130 controls the sound volume so that the hit sound (1) that corresponds to the hit sound in the close state is provided as the output signal.

Next, with reference to the graphical image in FIG. 6, what the graphical image of the process performed by the sound volume control part 130 will be described. In the graphical image of the process performed by the sound volume control part 130, the horizontal axis indicates time. FIG. 6 shows that a sound generation procedure is started when "vibration information that triggers a sound generation procedure is acquired". As in FIG. 3, the hit sound (1) represents a hit sound in the close state, the hit sound (8) represents a hit sound in the open state, the hit sounds (2) to (7) represent hit sounds in half-open states, and the triangles represent the envelopes of the sounds. In this example, again, N, which is the "predetermined number N of states", is 8. The vertical axis indicating the hit sounds represents the distance D between the top pad 910 and the bottom pad 920. The position of the hit sound (1) to (8) represents to which of the eight states the distance D corresponds. The hit sounds (1) to (8) represents the hit sounds in the respective states. To make the height of the envelopes of the sounds uniform, all the hit sounds (1) to (8) have the same range. In actual, however, the distance D is smallest in the state where the hit sound (1) is output and increases as the sound changes toward the hit sound (8). That is, the vertical axis does not accurately represent the distance D but only shows states at greater distances at higher positions.

Dotted lines (A) and (B) indicates examples of a position where the distance D is 0. In the example shown by the dotted line (A), the close state includes not only a state where the distance D is zero but also a state where the top pad 910 and the bottom pad 920 are slightly spaced apart from each other. In the example shown by the dotted line (B), the close state is only a state where the distance D is almost zero. The dotted line shown above the hit sound (8) indicates the position where the distance D between the top pad 910 and the bottom pad 920 is greatest. In the example shown in FIG. 6, the open state includes not only a state where the top pad 910 and the bottom pad 920 are farthest from each other but also a state close to the farthest state. A thick dotted line indicates a temporal change of the distance D between the top pad 910 and the bottom pad 920. In the example shown in FIG. 6, the state indicated by the state information is the state where the hit sound (5) is generated, and no state change occurs. The shaded region indicates the sound provided as the output signal.

In the example shown in FIG. 6, the current state at the time to start a sound generation procedure is not the close state (No in S210), so that the trigger part 120 starts the sound generation procedures for at least all the hit sounds (1) to (8) (S125). The sound volume control part 130 provides the hit sound (5) that corresponds to the hit sound in the state indicated by the state information as the output signal (S420). The initial sound volume can be determined in accordance with the intensity of the vibration. Since no state change occurs after that, the hit sound (5) is consistently provided as the output signal. Although the sound generation procedures do not involve the envelopes of the foot close sound and the foot open sound, the envelopes can be involved in the sound generation procedure and are therefore shown by dotted lines.

FIGS. 7 to 10 show graphical images of processes performed by the sound volume control part 130 when the state changes from a half-open state to the close state. FIG. 7 shows a case where the position indicated by the dotted line (A) is adopted as the position where the distance D is 0 and shows a graphical image of a procedure in which a vibration that falls within the predetermined range in which a sound generation procedure is to be started occurs when the distance D becomes 0. Since the current state at the time to start a sound generation procedure is not the close state (No in S210), the trigger part 120 starts the sound generation procedures for at least all the hit sounds (1) to (8) (S125), and the sound volume control part 130 provides the hit sound (5) that corresponds to the hit sound in the state indicated by the state information as the output signal (S420). After that, a state change occurs. For a while, the change is a change from a state other than the close state (No in S330), and the hit sound in the state indicated by the state information before the change is provided as the output signal (No in S360), so that the sound volume control part 130 controls the sound volume so that the hit sound in the state indicated by the state information after the change is provided as the output signal (S440). Therefore, the sound changes from the hit sound (5) to the hit sound (4), from the hit sound (4) to the hit sound (3), from the hit sound (3) to the hit sound (2), and then from the hit sound (2) to the hit sound (1). During this change, the height of the envelopes shown in FIG. 7 abruptly decreases. In view of this, when the state changes toward the close state, the sound volume control part 130 can control the sound volume so as to continuously attenuate by increasing a scaling factor of the sound volume of the output signal against the decreasing height of the envelopes.

When the distance D becomes 0, a vibration that falls within the predetermined range in which a sound generation procedure is to be started is detected (S112, S121), and the current sound generation procedure is ended (S122, S123). Since the current state is the close state, and the change of the distance meets the predetermined condition (Yes in S210 and Yes in S220), the trigger part 120 starts the sound generation procedures for the foot close sound, the foot open sound and all the hit sounds (1) to (8) (S124), and the sound volume control part 130 controls the sound volume so that the foot close sound is provided as the output signal (S410).

FIG. 8 shows a case where the position indicated by the dotted line (B) is adopted as the position where the distance D is 0 and shows a graphical image of a process in which a vibration that falls within the predetermined range in which a sound generation procedure is to be started occurs when the distance D becomes 0. The process from the time to start the sound generation procedure until the hit sound (2) is output is the same as that shown in FIG. 7. Therefore, the sound changes from the hit sound (5) to the hit sound (4), from the hit sound (4) to the hit sound (3), and then from the hit sound (3) to the hit sound (2). When the distance D becomes 0, the trigger part 120 starts the sound generation procedures for the foot close sound, the foot open sound and all the hit sounds (1) to (8) (S124), and the sound volume control part 130 controls the sound volume so that the foot close sound is provided as the output signal (S410). In the case shown in FIG. 7, the hit sound (1) is output because the position indicated by the dotted line (A) is adopted as the position where the distance D is 0. In the case shown in FIG. 8, however, since the position indicated by the dotted line (B) is adopted as the position where the distance D is 0, the hit sound (1) is not output or, if any, only momentarily output. That is, when the state changes from a half-open state to the close state, the sound in the close state can be adjusted based on where the position where the distance D is 0 is set (that is, the sound in the close state can be adjusted by adjusting the range of the close state). The position where the distance D is 0 can be appropriately set. In FIGS. 9 to 13, the position indicated by the dotted line (A) is adopted as the position where the distance D is 0.

FIG. 9 shows a graphical image of a process in which generation of a hit sound ends before the distance D becomes 0, and a vibration that falls within the predetermined range in which a sound generation procedure is to be started occurs when the distance D becomes 0. The process from the time to start the sound generation procedure until the hit sound (3) is output is the same as that shown in FIG. 7. Therefore, the sound changes from the hit sound (5) to the hit sound (4), and then from the hit sound (4) to the hit sound (3). After that, although the state changes from the state where the hit sound (3) is output to the state where the hit sound (2) is output, the hit sound (2) has already disappeared at that time. In this case, the sound volume control part 130 can fade the hit sound (3) out and end the sound generation procedure. For example, if the sound volume control part 130 switches the output signal to the hit sound (2) having already disappeared by cross-fade and ends the sound generation procedure after detecting in Step S310 that there is no output signal, the hit sound (3) can be substantially faded out. As the processing in Step S440, if there is no sound after the change, the sound before the change can be faded out, and the sound generation procedure can be ended. The sound generation procedure can be ended in any other ways, as far as the sound naturally attenuates. After that, when the top pad 910 comes closer to the bottom pad 920 and the distance D becomes 0, a vibration that falls within the predetermined range in which a sound generation procedure is to be started is detected (S112, S121), and the foot close sound is output (S210, S220, S124, S410).

FIG. 10 shows a graphical image of a process in which when the distance D becomes 0, there is no vibration that falls within the predetermined range in which a sound generation procedure is to be started. In this example, the state at the time to start the sound generation procedure is the state where the hit sound (3) is output, so that the trigger part 120 starts the sound generation procedures for at least all the hit sound (1) to (8) (S125), and the sound volume control part 130 controls the sound volume so that the hit sound in the state indicated by the state information is provided as the output signal (S420, S440). Therefore, the sound changes from the hit sound (3) to the hit sound (2), and then from the hit sound (2) to the hit sound (1). After that, although the distance D becomes 0, no vibration that falls within the predetermined range in which a sound generation procedure is to be started is detected (No in S121), so that the sound volume control part 130 continues outputting the hit sound (1) and ends the sound generation procedure when the hit sound (1) disappears.

FIG. 11 shows a graphical image of a process in which the state changes from a half-open state to the open state. The state at the time to start the sound generation procedure is the state where the hit sound (5) is output, and after that, the state changes as the distance D increases. Thus, the trigger part 120 starts the sound generation procedures for at least all the hit sound (1) to (8) (S125), and the sound volume control part 130 controls the sound volume so that the hit sound in the state indicated by the state information is provided as the output signal (S420, S440). Therefore, the sound changes from the hit sound (5) to the hit sound (6), from the hit sound (6) to the hit sound (7) and then from the hit sound (7) to the hit sound (8). When the hit sound (8) disappears, the sound generation procedure ends. During this change, the height of the envelopes shown in FIG. 11 abruptly increases. In view of this, when the state changes toward the open state, the sound volume control part 130 can control the sound volume so as to continuously attenuate by decreasing the scaling factor of the sound volume of the output signal against the increasing height of the envelopes.

FIGS. 12 and 13 show graphical images of processes when the state is changed only by a pedal operation. In the example shown in FIG. 12, the distance D becomes 0 as a result of a pedal operation, and the hi-hat cymbal sound generation apparatus 100 detects a vibration that falls within the predetermined range in which a sound generation procedure is to be started (S112, S121). The state at this time is the close state (Yes in S210), and the change of the distance meets the predetermined condition (Yes in S220), so that the trigger part 120 starts the sound generation procedures for the foot close sound, the foot open sound, and all the hit sounds (1) to (8) (S124), and the sound volume control part 130 controls the sound volume so that the foot close sound is provided as the output signal (S410). When the state changes to the state where the hit sound (2) is output before the predetermined time lapses from the start of the sound generation procedure (Yes in S320, Yes in S330, Yes in S340 and No in S350), the sound volume control part 130 controls the sound volume so that the foot open sound is output (S430). The "predetermined time" is a short period of time, such as 50 ms, 75 ms, or 100 ms.

If the state continues changing toward the open state even after the state change, that is, if the answer in Step S370 is No, the sound volume control part 130 continues outputting the foot open sound (S450). In FIG. 12, the state changes to the state where the hit sound (7) is output, and the foot open sound is maintained meanwhile. After that, when the state changes toward the close state (Yes in S370), the sound volume control part 130 controls the sound volume so that the hit sound in the state indicated by the state information is provided as the output signal, so that the hit sound (6) is output. The following process is similar to the process in FIG. 9. The sound changes from the hit sound (6) to the hit sound (5), from the hit sound (5) to the hit sound (4), from the hit sound (4) to the hit sound (3), and the sound generation procedure ends, and then to the foot close sound.

In the example shown in FIG. 13, again, the distance D becomes 0 as a result of a pedal operation, and a vibration that falls within the predetermined range in which a sound generation procedure is to be started is detected (S112, S121). The state at this time is the close state (Yes in S210), and the change of the distance meets the predetermined condition (Yes in S220), so that the trigger part 120 starts the sound generation procedures for the foot close sound, the foot open sound, and all the hit sounds (1) to (8) (S124), and the sound volume control part 130 controls the sound volume so that the foot close sound is provided as the output signal (S410). When the state changes to the state where the hit sound (2) is output after the predetermined time lapses from the start of the sound generation procedure (Yes in S320, Yes in S330, Yes in S340 and Yes in S350), the sound volume control part 130 controls the sound volume so that the hit sound (2) that corresponds to the hit sound in the state indicated by the state information is output (S440). The following process is similar to the process in FIG. 11. As the state changes, the sound changes from the hit sound (2) to the hit sound (3), from the hit sound (3) to the hit sound (4), from the hit sound (4) to the hit sound (5), from the hit sound (5) to the hit sound (6) and then from the hit sound (6) to the hit sound (7). In the example shown in FIG. 13, again, the sound volume control part 130 controls the sound volume so that the sound continuously attenuates when the sound changes. Therefore, if the sound changes as described above from a state where the foot close sound is small, the sound volume control part 130 controls the sound volume by decreasing the scaling factor, so that the hit sounds (2) to (7) are also small.

Since the hi-hat cymbal sound generation apparatus 100 includes the input part 110, the trigger part 120, the sound volume control part 130 and the recording part 190, the hi-hat cymbal sound generation apparatus 100 can provide the changes of sound shown in FIGS. 6 to 13. Therefore, the hi-hat cymbal sound generation apparatus 100 can provide a change of sound closer to that provided by the real hi-hat cymbals than prior art.

[Program and Recording Medium]

The various processings described above are not necessarily sequentially performed in the temporal order described above but can also be performed in parallel with or separately from each other depending on the processing capacity of the apparatus that performs the processings or as required. As required, of course, modifications can be made without departing from the spirit of the present invention.

When computer (a processing circuit) implements the arrangement described above, the specific processings of the functions that the apparatus needs to have are described in a program. The computer executes the program, thereby implementing the processing functions described above.

The program that describes the specific processings can be recorded in a computer-readable recording medium. The computer-readable recording medium may be any recording medium, such as a magnetic recording device, an optical disk, a magneto-optical recording medium, or a semiconductor memory.

The program is distributed by selling, transferring or loaning a portable recording medium, such as a DVD or a CD-ROM, in which the program is recorded, for example. Alternatively, the program may be stored in a storage unit in a server computer and distributed by transferring the program from the server computer to another computer via a network.

The computer that executes the program first temporarily stores, in a storage medium thereof, the program recorded on a portable recording medium or transferred from a server computer, for example. To perform the processings, the computer reads the program from the recording medium and performs the processings according to the read program. Alternatively, the computer may read the program directly from the portable recording medium and perform the processings according to the program, or the computer may perform the processings according to the program each time the computer receives a new program transferred from the server computer. As a further alternative, the processings described above may be performed on an application service provider (ASP) basis, in which the server computer does not transfer the program to the computer, and the processing functions are implemented only through execution instruction and result acquisition. The program according to this embodiment includes a quasi-program, which is information used in processings by a computer (such as data that is not a direct instruction to a computer but has a property that defines the processings performed by the computer).

Although the apparatus according to this embodiment has been described as being implemented by a computer executing a predetermined program, at least part of the specific processings may be implemented by hardware.

What is claimed is:

1. A hi-hat cymbal sound generation apparatus that generates a sound of hi-hat cymbals based on information on an operation to a top pad, which corresponds to a top cymbal, and a bottom pad, which corresponds to a bottom cymbal, the top pad and the bottom pad being attached to a hi-hat stand with a pedal, wherein a distance between the top pad and the bottom pad is changeable by an operation of the pedal, state information is information that indicates which of a predetermined number of states a state is, the state being determined by the distance between the top pad and the bottom pad, of the states, a state in which the top pad and the bottom pad are closest to each other is designated as a close state, and the hi-hat cymbal sound generation apparatus comprises:

an input that acquires at least the state information and vibration information, which is information on a vibration of the top pad;

a recorder that records data on a foot close sound that corresponds to a sound in the close state generated by the top cymbal and the bottom cymbal coming into contact with each other in response to an operation of the pedal, data on a foot open sound that corresponds to a sound in a state other than the close state generated by the top cymbal and the bottom cymbal coming into contact with each other in response to an operation of the pedal, and data on a predetermined number of hit sounds, which correspond to sounds generated by hitting in the states indicated by the state information;

a trigger that checks whether the vibration indicated by the vibration information falls within a predetermined range in which a sound generation procedure is to be started, and starts sound generation procedures for at least all the hit sounds when the trigger determines that the vibration falls within the range in which a sound generation procedure is to be started; and a sound volume controller that generates an output signal by controlling a sound volume of each sound whose sound generation procedure is being performed based on the current state information and information on a change of the distance between the top pad and the bottom pad.

2. The hi-hat cymbal sound generation apparatus according to claim 1, wherein at a time for the trigger to start a sound generation procedure, the trigger starts the sound generation procedures for all the hit sounds, and the sound volume controller controls the sound volume so that the hit sound in the state indicated by the state information is provided as the output signal if a current state is not the close state, or if a current state is the close state and the change of the distance between the top pad and the bottom pad does not meet a predetermined condition, and the trigger starts the sound generation procedures for the foot close sound, the foot open sound and all the hit sounds, and the sound volume controller controls the sound volume so that the foot close sound is provided as the output signal if the current state is the close state and the change of the distance between the top pad and the bottom pad meets the predetermined condition.

3. The hi-hat cymbal sound generation apparatus according to claim 2, wherein at a time other than the time for the trigger to start a sound generation procedure, (1) if a state change from the close state occurs, the sound volume controller (1-1) controls the sound volume so that the hit sound in the state indicated by the state information after the change is provided as the output signal if the output signal before the change is the hit sound in the close state, and (1-2) controls the sound volume so that the foot open sound is provided as the output signal if the output signal before the change is the foot close sound and a predetermined time has not lapsed from the start of the sound generation procedure, and (2) if a state change from a state other than the close state occurs, the sound volume controller (2-1) controls the sound volume so that the hit sound in the state indicated by the state information after the change is provided as the output signal if there is at least the hit sound in the state indicated by the state information after the change if the output signal before the change is the hit sound in the state indicated by the state information, (2-2) continues providing the foot open sound as the output signal if the output signal before the change is the foot open sound and the change of the state indicated by the state information is not a change toward the close state, and (2-3) controls the sound volume so that the hit sound in the state indicated by the state information after the change is provided as the output signal if there is at least the hit sound in the state indicated by the state information after the change if the output signal before the change is the foot open sound and the change of the state indicated by the state information is a change toward the close state.

4. The hi-hat cymbal sound generation apparatus according to claim 3, wherein the sound volume controller controls the sound volume so that the sound volume of the output signal after the change continuously attenuates from the sound volume of the output signal before the change.

5. The hi-hat cymbal sound generation apparatus according to claim 1, wherein the trigger ends a current sound generation procedure and starts a new sound generation procedure when the trigger determines that a vibration indicated by new vibration information acquired in the course of the current sound generation procedure falls within the predetermined range in which a sound generation procedure is to be started.

6. The hi-hat cymbal sound generation apparatus according to claim 1, wherein the recorder records a plurality of sets of data on the foot close sound, data on the foot open sound and data on the predetermined number of hit sounds, and the trigger starts a sound generation procedure by selecting a set of data that corresponds to an intensity of the vibration or the sound volume.

7. A computer-readable non-temporary recording medium in which a hi-hat cymbal sound generation program is recorded, the hi-hat cymbal sound generation program making a computer function as the hi-hat cymbal sound generation apparatus according to claim 1.

8. A hi-hat cymbal sound generation method that generates a sound of hi-hat cymbals based on information on an operation to a top pad, which corresponds to a top cymbal, and a bottom pad, which corresponds to a bottom cymbal, the top pad and the bottom pad being attached to a hi-hat stand with a pedal, wherein a distance between the top pad and the bottom pad is changeable by an operation of the pedal, state information is information that indicates which of a predetermined number of states a state is, the state being determined by the distance between the top pad and the bottom pad, of the states, a state in which the top pad and the bottom pad are closest to each other is designated as a close state, data on a foot close sound that corresponds to a sound in the close state generated by the top cymbal and the bottom cymbal coming into contact with each other in response to an operation of the pedal, data on a foot open sound that corresponds to a sound in a state other than the close state generated by the top cymbal and the bottom cymbal coming into contact with each other in response to an operation of the pedal, and data on a predetermined number of hit sounds, which correspond to sounds generated by hitting in the states indicated by the state information are previously recorded in a recorder, and the method comprises:

acquiring at least the state information and vibration information, which is information on a vibration of the top pad;

a triggering of checking whether the vibration indicated by the vibration information falls within a predetermined range in which a sound generation procedure is to be started, and reading at least all the hit sounds from the recorder and starting sound generation procedures for the hit sounds when the triggering determines that the vibration falls within the range in which a sound generation procedure is to be started; and a sound volume controlling of generating an output signal by controlling a sound volume of each sound whose sound generation procedure is being performed based on the current state information and information on a change of the distance between the top pad and the bottom pad.

9. The hi-hat cymbal sound generation method according to claim 8, wherein at a time for the triggering to start a sound generation procedure, the triggering starts the sound generation procedures for all the hit sounds, and the sound volume controlling controls the sound volume so that the hit sound in the state indicated by the state information is provided as the output signal if a current state is not the close state, or if a current state is the close state and the change of the distance between the top pad and the bottom pad does not meet a predetermined condition, and the triggering starts the sound generation procedures for the foot close sound, the foot open sound and all the hit sounds, and the sound volume controlling controls the sound volume so that the foot close sound is provided as the output signal if the current state is the close state and the change of the distance between the top pad and the bottom pad meets the predetermined condition.

10. The hi-hat cymbal sound generation method according to claim 9, wherein at a time other than the time for the triggering to start a sound generation procedure, (1) if a state change from the close state occurs, the sound volume controlling (1-1) controls the sound volume so that the hit sound in the state indicated by the state information after the change is provided as the output signal if the output signal before the change is the hit sound in the close state, and (1-2) controls the sound volume so that the foot open sound is provided as the output signal if the output signal before the change is the foot close sound and a predetermined time has not lapsed from the start of the sound generation procedure, and (2) if a state change from a state other than the close state occurs, the sound volume controlling (2-1) controls the sound volume so that the hit sound in the state indicated by the state information after the change is provided as the output signal if there is at least the hit sound in the state indicated by the state information after the change if the output signal before the change is the hit sound in the state indicated by the state information, (2-2) continues providing the foot open sound as the output signal if the output signal before the change is the foot open sound and the change of the state indicated by the state information is not a change toward the close state, and (2-3) controls the sound volume so that the hit sound in the state indicated by the state information after the change is provided as the output signal if there is at least the hit sound in the state indicated by the state information after the change if the output signal before the change is the foot open sound and the change of the state indicated by the state information is a change toward the close state.

11. The hi-hat cymbal sound generation method according to claim 10, wherein the sound volume controlling controls the sound volume so that the sound volume of the output signal after the change continuously attenuates from the sound volume of the output signal before the change.

12. The hi-hat cymbal sound generation method according to claim 8, wherein the triggering ends a current sound generation procedure and starts a new sound generation procedure when the triggering determines that a vibration indicated by new vibration information acquired in the course of the current sound generation procedure falls within the predetermined range in which a sound generation procedure is to be started.

13. The hi-hat cymbal sound generation method according to claim 8, wherein the recorder records a plurality of sets of data on the foot close sound, data on the foot open sound and data on the predetermined number of hit sounds, and the triggering starts a sound generation procedure by selecting a set of data that corresponds to an intensity of the vibration or the sound volume.

* * * * *